US011566767B2

(12) United States Patent
Crompvoets et al.

(10) Patent No.: US 11,566,767 B2
(45) Date of Patent: Jan. 31, 2023

(54) LIGHTING DEVICE WITH OPTICAL COMPONENT

(71) Applicant: LUMILEDS LLC, San Jose, CA (US)

(72) Inventors: Floris Maria Hermansz Crompvoets, Bunde (NL); Matthias Epmeier, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/671,363

(22) Filed: Feb. 14, 2022

(65) Prior Publication Data

US 2022/0260226 A1 Aug. 18, 2022

Related U.S. Application Data

(60) Provisional application No. 63/149,005, filed on Feb. 12, 2021.

(51) Int. Cl.

| | |
|---|---|
| ***F21S 41/148*** | (2018.01) |
| ***F21S 41/63*** | (2018.01) |
| ***F21S 41/29*** | (2018.01) |
| ***F21S 41/32*** | (2018.01) |
| *F21Y 107/30* | (2016.01) |

(52) U.S. Cl.

CPC ..... *F21S 41/635* (2018.01); *F21S 41/148* (2018.01); *F21S 41/29* (2018.01); *F21S 41/32* (2018.01); *F21Y 2107/30* (2016.08)

(58) Field of Classification Search

CPC ..... F21Y 2107/30; F21Y 2107/40; F21S 41/147–148

See application file for complete search history.

(56) References Cited

U.S. PATENT DOCUMENTS 7,048,412 B2 * 5/2006 Martin ..... F21V 29/77 362/545

FOREIGN PATENT DOCUMENTS

| | | |
|---|---|---|
| CN | 204387895 | 6/2015 |
| EP | 1371901 | 12/2003 |
| WO | 2014/148805 | 9/2014 |

OTHER PUBLICATIONS

International Search Report and Written Opinion dated May 4, 2022 for PCT International Application No. PCT/US2022/016348.

* cited by examiner

*Primary Examiner* — Sean P Gramling
(74) *Attorney, Agent, or Firm* — Volpe Koenig

(57) ABSTRACT

A lighting device, automotive lighting system and method of manufacturing a light device are described. A lighting device includes a mounting portion, at least one first light emitting element, at least one second light emitting element, and at least one optical component. The mounting portion includes at least a central mounting face and at least one lateral mounting face at an angle with respect to the central mounting face. The at least one first light emitting element is mounted on the central mounting face. The at least one second light emitting element is mounted on the at least one lateral mounting face. The at least one optical component is mounted to the mounting portion and configured to adjust an intensity distribution of light emitted from the at least one of the at least one first light emitting element or the at least one second light emitting element.

16 Claims, 6 Drawing Sheets

LIGHTING DEVICE WITH OPTICAL COMPONENT

CROSS REFERENCE TO RELATED APPLICATIONS

This application claims the benefit of U.S. Provisional Patent Application No. 63/149,005, which was filed on Feb. 12, 2021, the contents of which are hereby incorporated by reference herein.

BACKGROUND

Lighting devices such as halogen lamps have been standard light sources for automotive headlights for many years. However, recent advances in LED technology with concomitant new design possibilities and energy efficiency has spurred interest in finding suitable replacements for halogen lamps based on LED technology, such replacement being often referred to as LED retrofit.

SUMMARY

A lighting device, automotive lighting system and method of manufacturing a light device are described. A lighting device include a mounting portion, at least one first light emitting element, at least one second light emitting element, and at least one optical component. The mounting portion includes at least a central mounting face and at least one lateral mounting face at an angle with respect to the central mounting face. The at least one first light emitting element is mounted on the central mounting face. The at least one second light emitting element is mounted on the at least one lateral mounting face. The at least one optical component is mounted to the mounting portion and configured to adjust an intensity distribution of light emitted from the at least one of the at least one first light emitting element or the at least one second light emitting element.

BRIEF DESCRIPTION OF THE DRAWINGS

A more detailed understanding can be had from the following description, given by way of example in conjunction with the accompanying drawings wherein.

DETAILED DESCRIPTION

Figure 1:
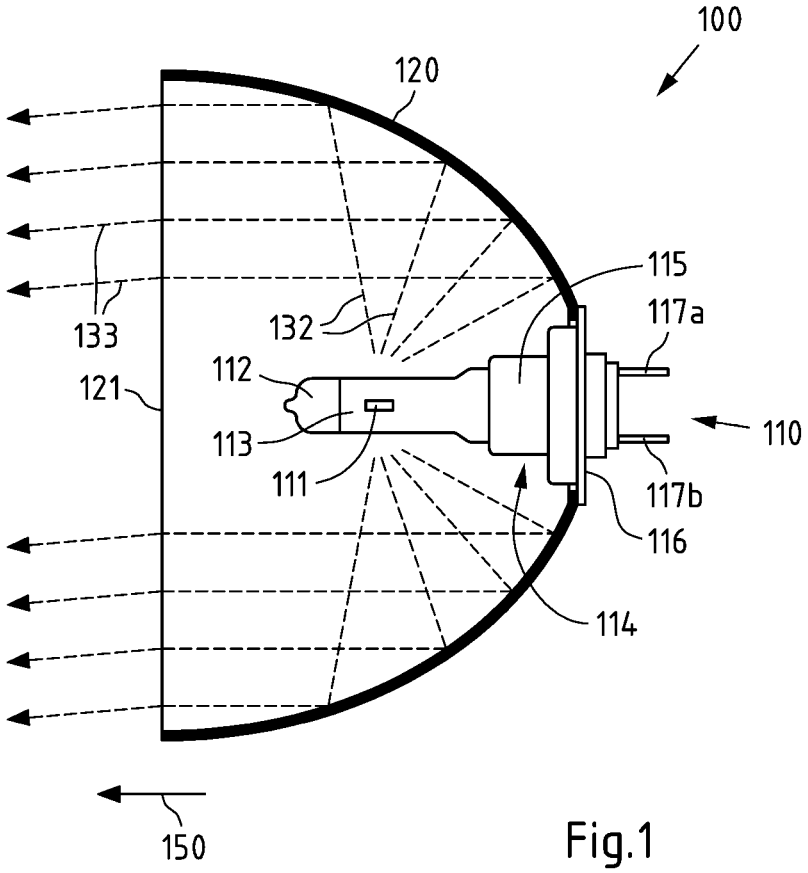
FIG. 1 illustrates an example headlight with a halogen lamp.

Examples of different light illumination systems and/or light emitting diode ("LED") implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will be understood that when an element such as a layer, region, or substrate is referred to as being "on" or extending "onto" another element, it may be directly on or extend directly onto the other element or intervening elements may also be present. In contrast, when an element is referred to as being "directly on" or extending "directly onto" another element, there may be no intervening elements present. It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper,", "lower," "horizontal" or "vertical" may be used herein to describe a relationship of one element, layer, or region to another element, layer, or region as illustrated in the figures. It will be understood that these terms are intended to encompass different orientations of the device in addition to the orientation depicted in the figures.

While LED retrofits have become popular in recent years, capabilities of LED retrofits in mimicking halogen lamps are not yet optimal. For example, differing geometries of light emission regions of halogen lamps (filaments) and, for example, LED dies (light emission surfaces) may cause difficulties when LED dies are used for mimicking the light emission of a halogen lamp not only in the near field but also in the far field.

An approach to mimic a halogen lamp filament is to arrange two to three rows of LEDs, such as particular LED dies, on two to three respective surfaces or mounting faces of an elongated mounting portion to emit light in respective directions. A lighting device comprising such an LED arrangement may serve as an LED based replacement for a halogen lamp and may, thus, be referred to as an LED retrofit. While that LED arrangement may be suitable to mimic a near-field luminance profile of a halogen lamp, mimicking also a far-field intensity profile of a halogen lamp still remains a problem to be solved. It was in particular found that a superposition of usually Lambertian light intensity profiles of individual LEDs may cause undesirable intensity peaks in lighting directions forming an angle of 45° with respective surface normals of adjacent mounting faces.

Embodiments described herein may provide a lighting device with improved capability for optimally mimicking light emission properties of a conventional halogen lamp and provide a corresponding headlight and method of manufacturing a corresponding lighting device.

FIG. 1 shows a headlight 100 with a reflector 120 to which an exemplary conventional H7 halogen lamp 110 is mounted. A filament 111 of halogen lamp 110 may be placed at a focus of reflector 120 such that light 132 emitted from filament 111 is reflected by the reflector 120 along a main lighting direction 150. A cover 121 may incorporate suitable optics for shaping the reflected light and to form light 133 leaving headlight 100. In the illustrated example, the lamp 110 comprises a socket 114 mounted to reflector 120 via mounting portion 116. Pins 117*a* and 117*b* may extend from socket 114 for power connection. A bulb 113 may extend from the base portion 115 surrounding the filament 111 and may end in a light blocking member 112, which may block direct light from the filament 111.

Figure 2A:
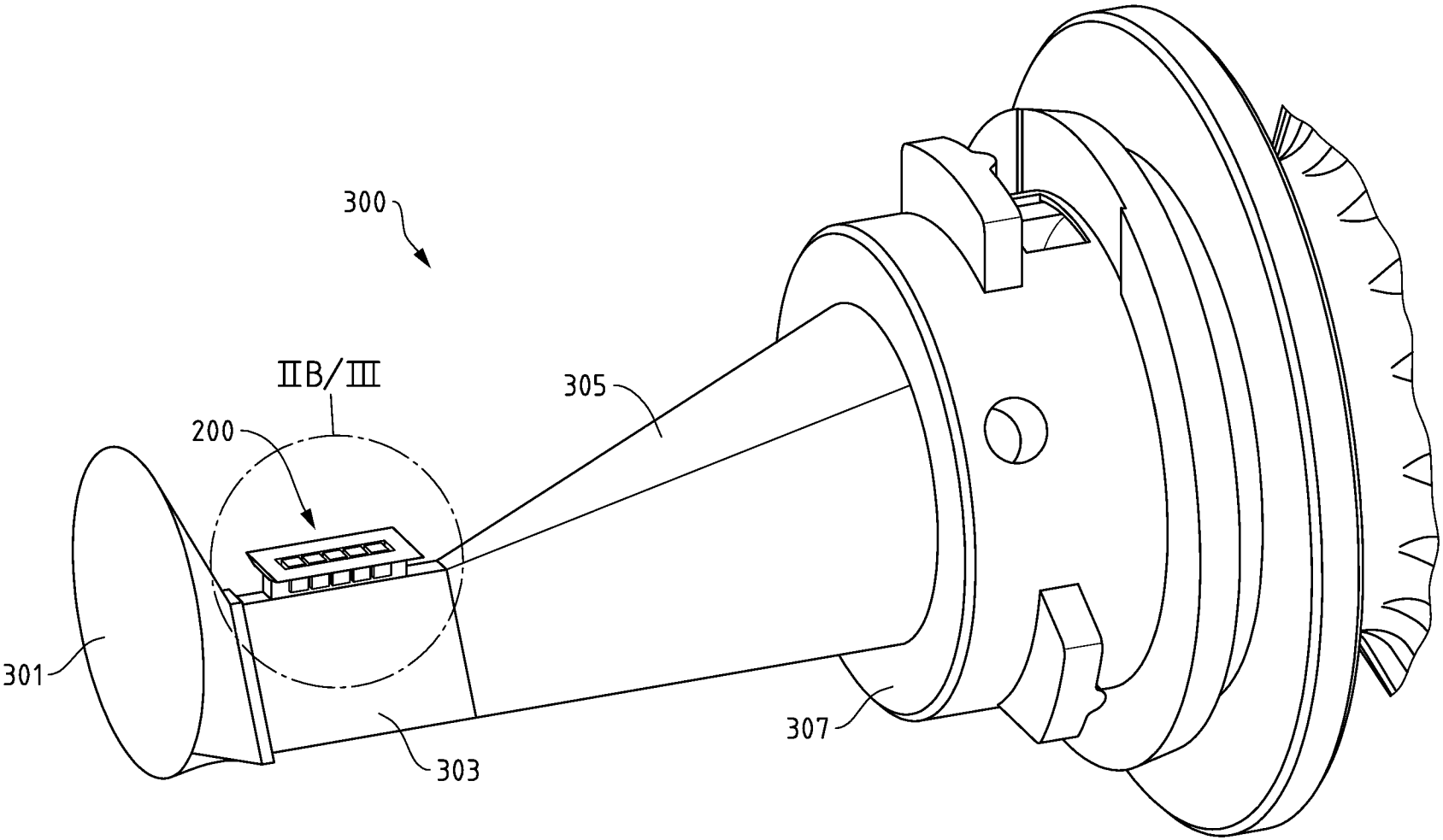
FIG. 2A illustrates an example lighting device.

FIG. 2A shows a lighting device 300, which may be used as retrofit light source for a headlight, such as an automotive headlight. In other words, the lighting device 300 may be used, for example, as a replacement of halogen lamp 110 of FIG. 1. Lighting device 300 may include a socket portion 307, a connection portion 305, and a heat dissipation portion 303 supporting mounting portion 210 (shown in FIG. 2B). Lighting device 300 may further include a light blocking portion 301, which may block direct light from the light emitting portion 200, which otherwise may cause an undesirable light emission when lighting device 300 is used (e.g., as light source for an automotive headlight).

Figure 2B:
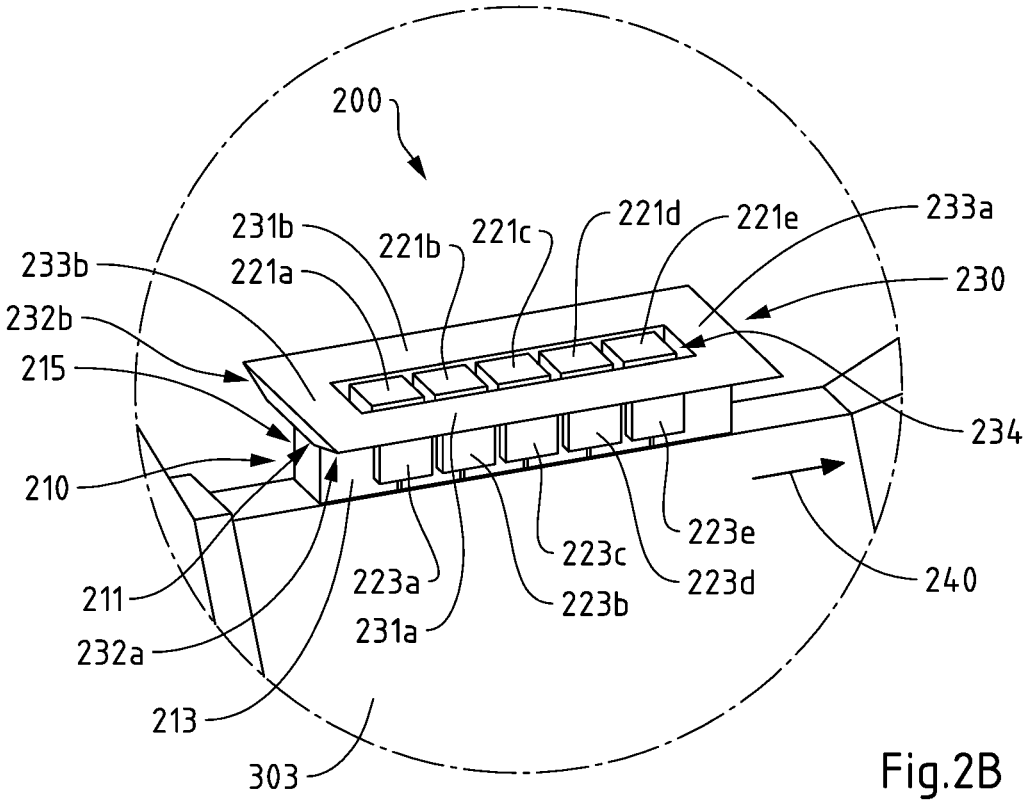
FIG. 2B illustrates a detail view of the lighting device of FIG. 2A.

FIG. 2B shows the mounting portion 210, which may extend essentially along a length direction 240 and which comprises a central mounting face 211, a lateral mounting face 213 and a third mounting face 215. The third mounting face 215 may be arranged adjacent to the central mounting face 211 and opposing the lateral mounting face 213. As can be seen in FIG. 2B, the central mounting face 211 and the lateral mounting face 213 may be arranged at an angle of approximately 90°, and the central mounting face 211 and the third mounting face 215 may also be arranged at an angle of approximately 90°.

A plurality of Light Emitting Diodes (LEDs) 221*a*, 221*b*, 221*c*, 221*d*, 221*e* (examples of first light emitting elements) may be arranged along the length direction 240 on the central mounting face 211. Similarly, a plurality of LEDs 223*a*, 223*b*, 223*c*, 223*d*, 223*e* (examples of second light emitting elements) may be arranged along the length direction 240 on the lateral mounting face 213. Additionally, a plurality of LEDs (examples of third light emitting elements; not visible in the figure) may similarly be arranged along the length direction 240 on the third mounting face 215. Arranging respective pluralities of LEDs on the different faces of mounting portion 210 along the length direction 240 may advantageously mimic a filament 111 of a conventional halogen lamp 110 as shown in FIG. 1 such that lighting device 300 may advantageously be employed as a replacement for a conventional halogen lamp in combination with existing optical systems.

As mentioned above, a Lambertian light emission of LEDs 223*a*, 223*b*, 223*c*, 223*d*, 223*e* may add, for example, to a corresponding Lambertian light emission of LEDs 221*a*, 221*b*, 221*c*, 221*d*, 221*e* and may thus cause undesirable light intensity peaks at light emission angles around 45° with respect to a surface normal on the central mounting face 211. Addressing this problem, optical component 230 may be mounted to the mounting portion 210 (e.g., to the central mounting face 211 in the example) and may include two wing portions 231*a*, 231*b* with respective reflective surfaces 232*a*, 232*b* and two joining portions 233*a*, 233*b* connecting the at least two wing portions 231*a*, 231*b*. As can be seen, taking into account also FIG. 2A, the optical component 230 may be realized as a compact member attached to the mounting portion 210 and not extending beyond the heat dissipation portion 303. Such compact member may be advantageous in terms of mounting simplicity, reliability and stability.

By means of the reflective surfaces 232*a*, 232*b*, the optical component 230 may reflect at least part of light emitted from LEDs 223*a*, 223*b*, 223*c*, 223*d*, 223*e*, thereby reducing an overall intensity of light emitted by the lighting device 300 in regions of maximum overlap of light emitted from LEDs 221*a*, 221*b*, 221*c*, 221*d*, 221*e* and LEDs 223*a*, 223*b*, 223*c*, 223*d*, 223*e*. In this way, undesired intensity peaks at an angle of approximately 45° with respect to a surface normal of the central mounting face 211 may thus advantageously be avoided and a desired light intensity profile may be achieved. To this end, alternatively or in addition, the optical element 230 may also be configured to refract and/or absorb light.

By providing the at least one optical component configured to adjust an intensity distribution of light emitted from the at least one first light emitting element and/or from the at least one second light emitting element mounted to the mounting portion, it becomes on the one hand possible to suitably adjust a distribution of light emitted from the first and second light emitting elements, for example to prevent undesirable intensity peaks. In particular, in an exemplary embodiment, the at least one optical component may be configured to adjust an intensity of light emitted by the at least one first and the at least one second light emitting element, in particular in spatial regions where light emitted by the at least one first and the at least one second light emitting element overlaps. In addition, by providing the optical component mounted to the mounting portion, a reproducible mounting of the optical component may be facilitated, while at the same time a particularly stable and reliable construction may be enabled.

In an exemplary embodiment, the at least one first and the at least one second light emitting element may be respectively in direct mechanical contact with the central mounting face and/or the at least one lateral mounting face. Alternatively, or in addition, in an exemplary embodiment, the mounting portion may be formed from metal, such as lead, aluminum, gold, copper, and/or silver. Thereby, in an exemplary embodiment, the at least one first light emitting element and/or the at least one second light emitting element may be thermally coupled to (e.g., in direct mechanical contact with) the mounting portion. Heat generated by the light emitting elements may thus be efficiently guided away.

In an exemplary embodiment, the central mounting face and the at least one lateral mounting face may be arranged at an angle of 90°±5° with respect to each other. For example, the mounting portion may be, in an exemplary embodiment, a cuboid, such as a rectangular cuboid, such as with a square base area. The central mounting face and the at least one lateral mounting face may be rectangular. Use of regular shapes like cuboids and/or rectangles may advantageously facilitate a corresponding manufacturing process while at the same time mounting of components such as light emitting elements and/or the at least one optical component may be facilitated.

In an exemplary embodiment, the at least one lateral mounting face may be arranged (e.g., directly) adjacent to the central mounting face. In other words, in an exemplary embodiment, the at least one lateral mounting face may be directly connected to the at least one central mounting face, in particular via a corresponding edge portion. For example, in the embodiment in which the mounting portion corresponds to or comprises a cuboid, the central mounting face and the at least one lateral mounting face may correspond to respective faces of the cuboid.

In an exemplary embodiment, both the central mounting face and the at least one lateral mounting face may comprise at least sections of the mounting portion onto which the at least one first and the at least one second light emitting element are respectively mounted. Further, in an exemplary embodiment, the central mounting face and the at least one lateral mounting face may further comprise respective outer sections, such as surface sections not covered by any of the at least one first or the at least one second light emitting element, whereby the outer sections may respectively surround corresponding sections onto which the at least one first and the at least one second light emitting elements are mounted. The outer sections may allow for mounting further components of the lighting device to the mounting portion in close proximity with the at least one first and/or the at least one second light emitting elements.

In an exemplary embodiment, the at least one first and the at least one second light emitting element may be Light Emitting Diodes (LEDs), such as LED dies. Using LEDs may be advantageous in terms of efficiency.

In an exemplary embodiment, the at least one optical component may be mounted, such as by being mechanically fixed, to the mounting portion, such as by gluing and/or soldering. While the at least one optical component may thus be mounted in direct contact with the mounting portion, in an exemplary embodiment, at least one intermediate mounting member (e.g., a mounting platform) may be arranged in between the at least one optical component and the mounting portion. For example, in case the at least one optical component is a fragile member, such mounting portion may help to facilitate a manufacturing process and to ensure robustness and reliability.

In an exemplary embodiment, the at least one optical component may be formed from one or more of a metal, such as aluminum, polished and/or coated aluminum, or an aluminum foil, glass, or a glass sheet. In an exemplary embodiment, the at least one optical component may have a flat shape. Additionally, or alternatively, a length of the at least one optical component along a length direction of the mounting portion may be essentially equal to a length of the mounting portion along the length direction.

In an exemplary embodiment, the at least one optical component may be configured to adjust the intensity distribution based on at least one of reflection, refraction, and absorption. In particular, in an exemplary embodiment, the at least one optical component may be configured to reflect light that is emitted by the at least one second light emitting element, such as at least light that is emitted by the at least one second light emitting element in a direction at an angle of more than 20° with respect to a surface normal of the at least one lateral mounting face towards the at least one first light emitting element, such as more than 30° and/or more than 40°.

Thus, reflecting light emitted by the at least one second light emitting element in this way, the at least one optical component may advantageously allow for redistributing light emitted by the at least one second light emitting element away from regions where otherwise light emitted from the at least one first and the at least one second light emitting element overlap (e.g., in lighting directions forming angles of about 45° with respective surface normals of adjacent mounting faces). In this way, a light intensity within such regions may be reduced, and undesirable intensity peaks may be avoided that may otherwise cause undesirable effects such as, for example, cause of disturbance to oncoming traffic if the lighting device is used as a light source for a headlight. It is noted that in an exemplary embodiment, the headlight may be an automotive headlight. The at least one optical component may thus advantageously help to homogenize an emission profile of light emitted from the at least one first light emitting element and the at least one second light emitting element.

It is noted that a similar effect can be achieved by configuring the at least one optical component to absorb light emitted from the at least one first and/or the at least one second light emitting element as absorption may similarly help to reduce an intensity in an area or region where light intensities from the at least one first and the at least one second light emitting element overlap. The at least one optical component may, to this end, correspond to or comprise an absorption filter, such as a thin metal film or coating, which may be provided, for example, as a free standing member or on a suitable substrate such as glass. The effect may similarly be achieved by means of refraction. To this end, the at least one optical component may correspond to or include at least one refractive member, such as at least one prism and/or at least one Fresnel lens. Alternatively, or in addition, in an exemplary embodiment, the at least one optical component may include or correspond to a light guiding component, such as a light guiding sheet, such as a glass and/or plastic sheet, configured for guiding light emitted from the at least one first and/or the at least one second light emitting element.

The two wing portions 231*a*, 231*b* may extend from an outer section of the central mounting face 211 adjacent to the lateral mounting face 213. Alternatively, or in addition, wing portions 231*a*, 231*b* may also extend from an outer section of the lateral mounting face 213 adjacent to the central mounting face 211. As can be taken from FIG. 2B, the illustrated optical component 230 comprises a tapered cross-section, such that reflective surfaces 232*a*, 232*b* form respective angles larger than 85° (in the illustrated case, for example, the angles are approximately 105° with the lateral mounting face 213). As shown in FIG. 2B, wing portions 231*a*, 231*b* may extend along the length direction 240 and have a width perpendicular to the length direction 240 away from the mounting portion 210 of approximately 75% of a corresponding width of the lateral mounting face 213 in a direction perpendicular to the length direction 240.

The two wing portions 231*a*, 231*b* may be respectively arranged at opposing sides with respect to the LEDs 221*a*, 221*b*, 221*c*, 221*d*, 221*e*. With the two joining portions 233*a*, 233*b*, the two wing portions 231*a*, 231*b* may be arranged around the LEDs 221*a*, 221*b*, 221*c*, 221*d*, 221*e* and, thus, form a frame-shaped member mounted to an outer section of the central mounting face 211, thereby enclosing the LEDs 221*a*, 221*b*, 221*c*, 221*d*, 221*e*. The two wing portions 231*a*, 231*b* and two joining portions 233*a*, 233*b* may be arranged in a common plane and form an essentially flat surface with a central opening 234, through which the LEDs 221*a*, 221*b*, 221*c*, 221*d*, 221*e* may protrude. It is noted that, in an exemplary embodiment, inner surfaces facing LEDs 221*a*, 221*b*, 221*c*, 221*d*, 221*e* may be at least partially reflective. In this way, light emission efficiency may advantageously be improved.

In an exemplary embodiment, the at least one wing portion may be edge, blade, and/or flank shaped, such as comprising a rectangular, quadratic and/or triangular shape. Thereby, in an exemplary embodiment, the at least one wing portion may extend from a section (e.g., an edge section) of the mounting portion connecting the at least one central and the at least one lateral mounting faces in between the at least one first and the at least one second light emitting element, thereby extending from any of the respective outer sections of the mounting portion. This construction of the at least one optical component may enable provision of at least portions thereof to be placed in close proximity with the light emitting elements and thus advantageously may allow for precisely and reliably adjusting an intensity distribution of light emitted by the lighting device.

Thereby, in an exemplary embodiment, an intensity of light emitted by the at least one first and/or the at least one second light emitting element within an angular range of 45°±25°, such as ±15° with respect to a surface normal of the central mounting face and/or with respect to the at least one lateral mounting face may be reduced by at least 10%, at least 20%, and/or at least 30%. In an exemplary embodiment, an intensity reduction at 45° may be 40%±10%. Thereby, a homogenous light emission profile may be provided, which may help to reduce the described undesirable intensity peaks, which may otherwise be present in areas of overlapping Lambertian light intensity profiles of respective light emitting elements.

In an exemplary embodiment, the at least one wing portion may include an at least partially reflective surface, such as on a side of the at least one wing portion pointing away from the at least one first light emitting element and facing the at least one second light emitting element. Thereby, in an exemplary embodiment, the at least partially reflective surface may advantageously allow for reflecting at least part of light emitted from the at least one second light emitting element. Being at least partially reflective, in an exemplary embodiment, the at least partially reflective surface may be configured to reflect at least 50%, at least 75%, and/or at least 95% of incident light.

In an exemplary embodiment, the at least partially reflective surface may form an angle of at least 85°, such as an angle of at least 90°, with the at least one lateral mounting face. To this end, the at least partially reflective surface may be straight and/or sloped. An angle of at least 85° may enable efficiently adjusting the light emission profile, such as an intensity profile or far-field intensity profile, of the lighting device. At the same time, in an exemplary embodiment, the at least one optical component may correspond to a shield forming an angle of essentially 90° with at least one lateral mounting face. Use of such shield may enable reduced complexity of construction and provide advantageous light scattering. In an alternative embodiment, the at least partially reflective surface may form an angle of at least 105° with the at least one lateral mounting face. For example, in this case, the at least partially reflective surface may correspond to a surface of an optical component comprising a tapered and/or trigonal cross-section.

In an exemplary embodiment, the at least one wing portion may extend substantially along a length direction of the mounting portion, and a width of the at least one wing portion in a direction perpendicular to the length direction away from the mounting portion may be at least 20% of a corresponding width of a light emitting surface of the at least one second light emitting device, such as in a direction perpendicular to the length direction. In other words, the at least one wing portion may protrude over a surface of the mounting portion by at least 20% of a corresponding width of the light emitting surface of the at least one second light emitting device in a direction perpendicular to the length direction, such as by at least 40% and/or at least 60%. For example, a width of the at least one wing portion perpendicular to the length direction may be, in an exemplary embodiment, in a range of 500 μm±250 μm.

In this way, the wing portion may suitably reflect light emitted from the at least one second light emitting element and, thus, may help to reduce the undesirable intensity peaks.

In an exemplary embodiment, the lighting device may include at least two first light emitting elements and/or at least two second light emitting elements arranged along the length direction. Thereby, in an exemplary embodiment, the at least one wing portion may extend along a length direction of the mounting portion and span at least an extension of the at least two first light emitting elements and/or the at least two second light emitting elements in the length direction. The wing portion may thus advantageously support reflection of light emitted from all of the at least two second light emitting elements.

Figure 3:
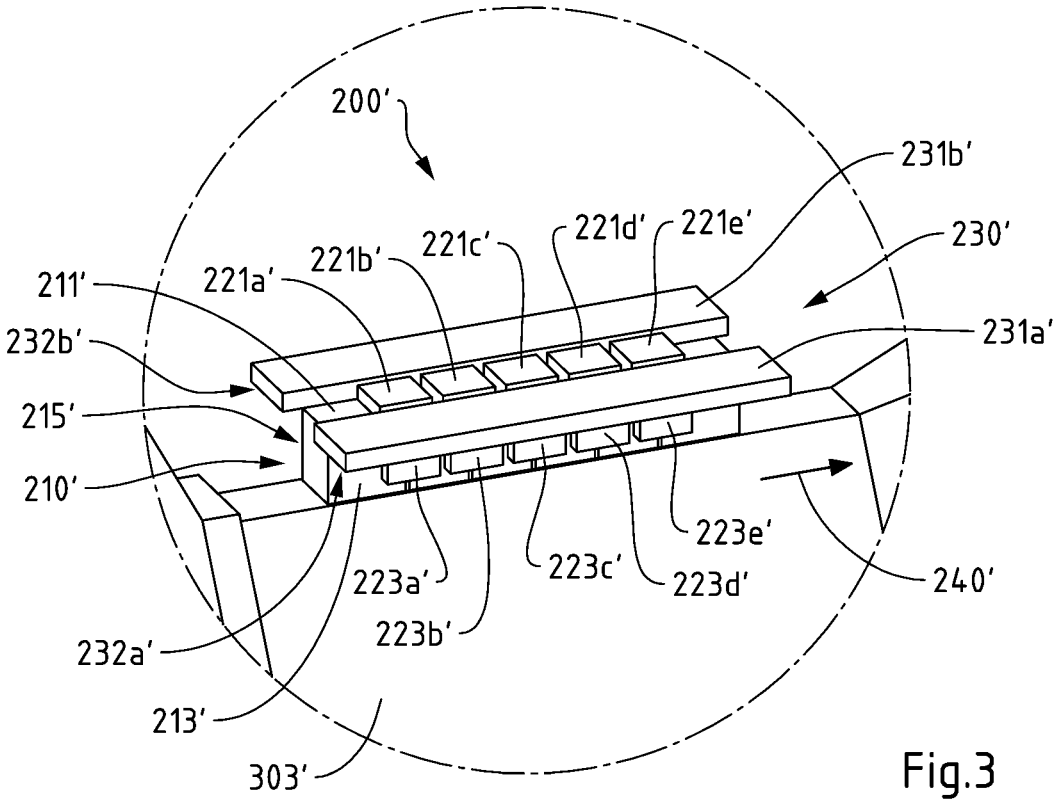
FIG. 3 illustrates a detail view of an example lighting device.

FIG. 3 shows a light emitting portion 200', according to a further exemplary embodiment, mounted to a heat dissipation portion 303'. Light emitting portion 200' may include features corresponding to the features of the light emitting portion 200, whereby joining portions 233*a*, 233*b* shown in FIG. 2B are omitted. Thus, as opposed to the frame-shaped optical component 230 of FIG. 2B, the light emitting portion 200' may include two optical components 230' in the form of respective wing portions 231*a*', 231*b*', respectively having a rectangular cross-section. Again, as in the case of FIG. 2B, the reflective surfaces 232*a*, 232*b* may form respective angles larger than 85°, such as in the shown case of approximately 90° with the lateral mounting face 213'. While not shown in the figures, alternatively or in addition, respective wing portions 231*a*', 231*b*' may extend to be connected with the light blocking portion 301 on one side and/or to be connected with the connection portion 305 and/or a socket portion 307, which may be advantageous in terms of additional stability.

In an exemplary embodiment, the at least two wing portions and the at least two joining portions may be at least in part arranged around the at least one first light emitting element. In other words, in an exemplary embodiment, the at least one optical component include or correspond to a frame-shaped member mounted to the outer section of the central mounting face enclosing the at least one first light emitting element. Arranging the at least one optical component around the at least one first light emitting element and/or enclosing the at least one first light emitting element with the at least one optical component may advantageously enable a compact architecture, a simplified mechanical mounting and an improved mechanical stability and reliability.

In an exemplary embodiment, the at least two wing portions and the at least one joining portion may be arranged in a common plane forming at least one essentially flat surface with a central opening. The at least one first light emitting element may protrude at least in part through the central opening. In other words, in an exemplary embodiment, a height of the at least one first light emitting element measured from the central mounting face may be equal to or more than a height of the at least one optical component measured from the central mounting face. The at least one first light emitting element protruding at least in part through the central opening of the at least one essentially flat surface may advantageously avoid blocking of light emitted by the at least one first light emitting element by the at least one optical element leading to undesired flux losses. At the same time, the construction may enable a precise and stable mounting of the at least one optical component with respect to the mounting section. In an exemplary embodiment, inner surfaces facing the at least one first light emitting element may be at least partially reflective. In this way, light emission efficiency may advantageously be improved.

In an exemplary embodiment, the at least one optical component may have a tapered cross-section, which may define the angle formed by the partially reflective surface with the at least one lateral mounting face. In an exemplary embodiment, the tapered cross-section may be perpendicular to the length direction. Thus, in an exemplary embodiment, the at least one optical component may have an essentially triangular cross-section with at least one side of the triangle forming an angle of more than 45°, more than 60°, more than 75°, and/or less than 90° with respect to the central mounting face and/or the at least one lateral mounting face. In other words, in an exemplary embodiment, the partially reflective surface may be inclined with respect to a surface normal of the at least one lateral mounting face. A tapered cross-section may advantageously mimic an optical element with a rectangular cross-section, which may form an angle with respect to the central mounting face and/or the at least one lateral mounting face, while offering a particularly compact shape and a reliable mount. It is noted that, in an exemplary embodiment, in which the lighting device comprises two optical components, each provided on a respective one of two opposing lateral mounting faces, each of the respective optical components may comprise a triangular cross-section. In such case, the two optical components may together form a trapezoidal cross-section.

In an exemplary embodiment, the central mounting face and the at least one lateral mounting face may be arranged at an angle of 90°±5° with respect to each other. Further, in an exemplary embodiment, the mounting portion may further comprise a third mounting face arranged adjacent to the central mounting face and opposing the at least one lateral mounting face. At least one third light emitting element may be arranged on the third mounting face. For example, the central mounting face and the third mounting face may be arranged at an angle of 90°±5° with respect to each other. In an exemplary embodiment, the central mounting face, the at least one lateral mounting face and/or the third mounting face may form respective rectangular faces of the mounting portion, such as a cuboid mounting portion. In an exemplary embodiment, the at least one third light emitting element may be a Light Emitting Diode (LED), such as an LED die. With such shape, the mounting portion may be suitably usable for arrangements of light emitting elements for mimicking a filament of a Halogen lamp such that the lighting device may be suitably employed as Halogen lamp retrofit.

In addition to at least two first and to at least two second light emitting elements, in an exemplary embodiment, the lighting device may include at least two third light emitting elements arranged along the length direction. The corresponding arrangement of first, second and third light emitting elements may thus mimic a shape of a (halogen) filament such that the corresponding lighting device may be a suitable retrofit.

In an exemplary embodiment, the lighting device may further include a support structure with a heat dissipation portion arranged in between a connection portion and a light blocking portion. The mounting portion may be arranged on the heat dissipation portion. In an exemplary embodiment, a width of the heat dissipation portion perpendicular to a length direction of the mounting portion may increase along a direction away from the mounting portion. In this way, heat generated by the light emitting elements may be advantageously guided away from the mounting portion. While the connection portion may serve for mechanically installing the mounting portion, such as for mechanically connecting the mounting portion with a socket of the lighting device, the light blocking portion may be arranged and configured for blocking direct light emitted from the light emitting elements in directions essentially parallel to a length direction of the mounting portion. It is noted that, in an exemplary embodiment, the at least one wing portion may not extend beyond the heat dissipation portion in the length direction. Being thus confined to a longitudinal extension of the heat dissipation portion, the at least one optical component may be realized as a compact and a stable component.

Figure 4:
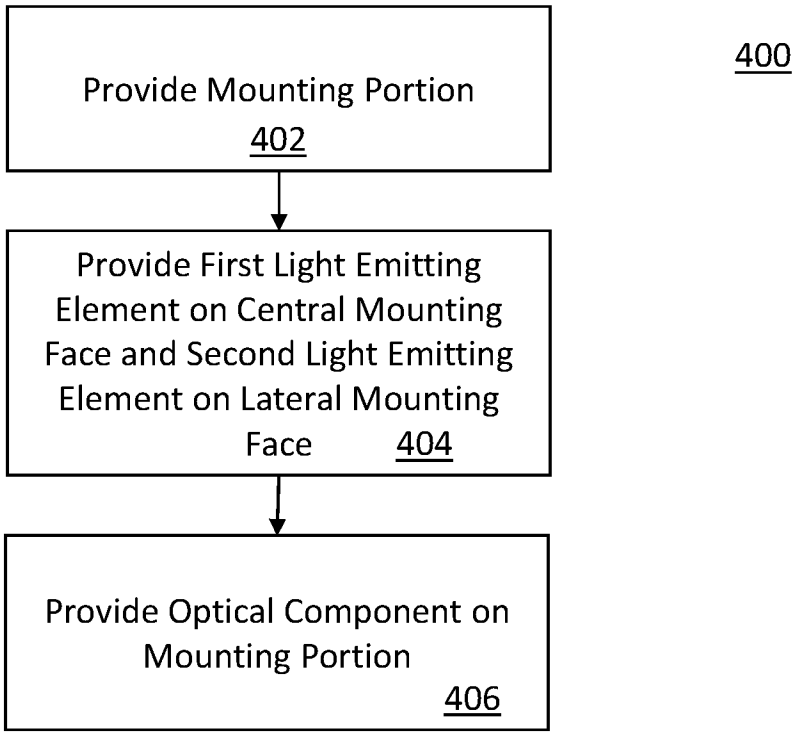
FIG. 4 is a flow diagram of an example method of manufacturing a lighting device, such as the lighting device of FIG. 2A.

FIG. 4 is a flow diagram 400 of an example method of manufacturing a lighting device, such as the lighting device 300 of FIG. 2A. In the example illustrated in FIG. 4, the method includes providing a mounting portion (402). In embodiments, the mounting portion may include at least a central mounting face and at least one lateral mounting face. The at least one lateral mounting face may be arranged at an angle with respect to the central mounting face. A first light emitting element may be provided on the central mounting face, and a second light emitting element may be provided on the lateral mounting face (404). At least one optical component may be provided on the mounting portion (406). The optical component may be configured to adjust an intensity distribution of light emitted from at least one of the at least one first light emitting element or from the at least one second light emitting element.

Figure 5:
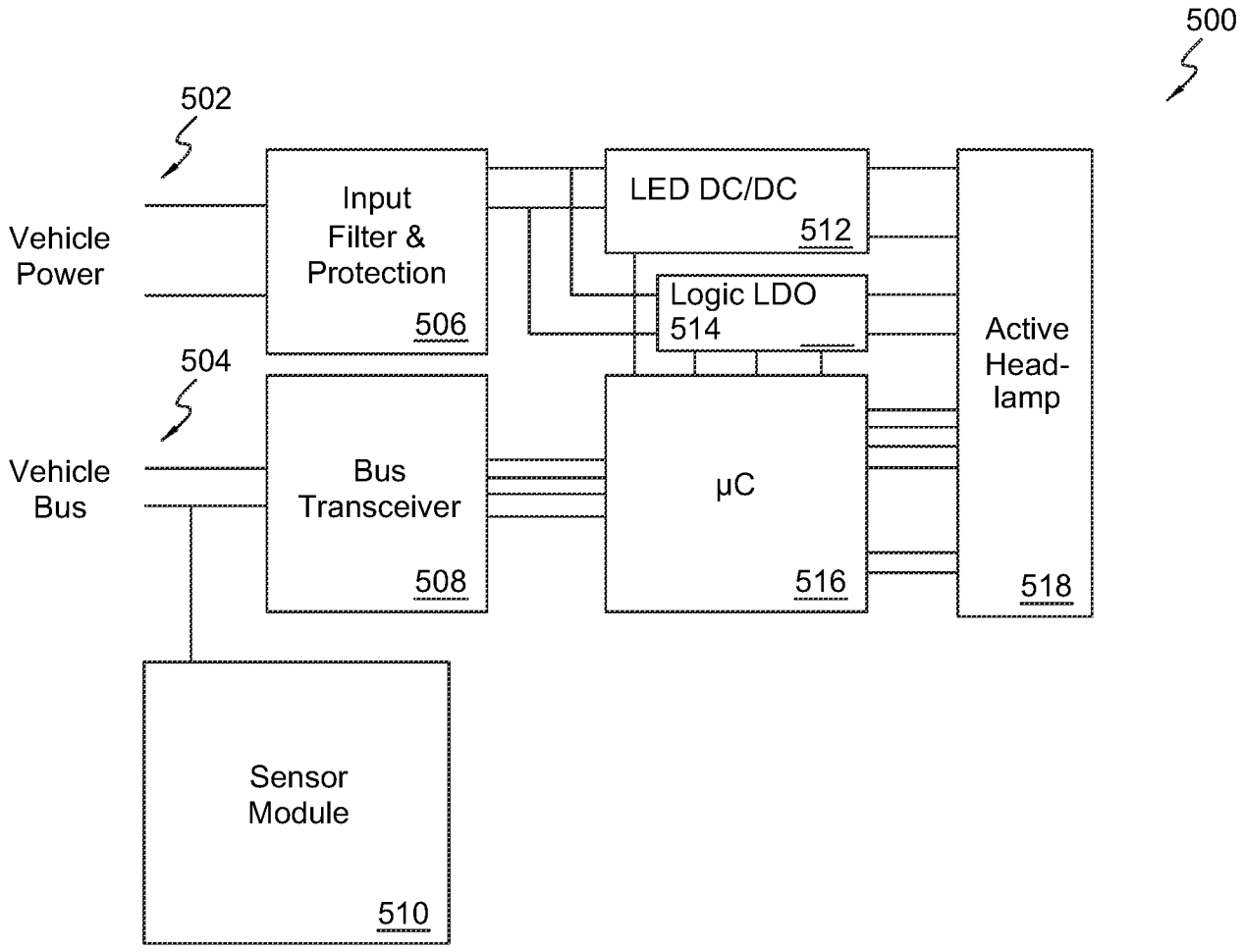
FIG. 5 is a diagram of an example vehicle headlamp system that may incorporate one or more of the embodiments and examples described herein.

FIG. 5 is a diagram of an example vehicle headlamp system 500 that may incorporate one or more of the embodiments and examples described herein. The example vehicle headlamp system 500 illustrated in FIG. 5 includes power lines 502, a data bus 504, an input filter and protection module 506, a bus transceiver 508, a sensor module 510, an LED direct current to direct current (DC/DC) module 512, a logic low-dropout (LDO) module 514, a micro-controller 516 and an active head lamp 518.

The power lines 502 may have inputs that receive power from a vehicle, and the data bus 504 may have inputs/outputs over which data may be exchanged between the vehicle and the vehicle headlamp system 500. For example, the vehicle headlamp system 500 may receive instructions from other locations in the vehicle, such as instructions to turn on turn signaling or turn on headlamps, and may send feedback to other locations in the vehicle if desired. The sensor module 510 may be communicatively coupled to the data bus 504 and may provide additional data to the vehicle headlamp system 500 or other locations in the vehicle related to, for example, environmental conditions (e.g., time of day, rain, fog, or ambient light levels), vehicle state (e.g., parked, in-motion, speed of motion, or direction of motion), and presence/position of other objects (e.g., vehicles or pedestrians). A headlamp controller that is separate from any vehicle controller communicatively coupled to the vehicle data bus may also be included in the vehicle headlamp system 500. In FIG. 5, the headlamp controller may be a micro-controller, such as micro-controller (μc) 516. The micro-controller 516 may be communicatively coupled to the data bus 504.

The input filter and protection module 706 may be electrically coupled to the power lines 502 and may, for example, support various filters to reduce conducted emissions and provide power immunity. Additionally, the input filter and protection module 506 may provide electrostatic discharge (ESD) protection, load-dump protection, alternator field decay protection, and/or reverse polarity protection.

The LED DC/DC module 512 may be coupled between the input filter and protection module 106 and the active headlamp 518 to receive filtered power and provide a drive current to power LEDs in the LED array in the active headlamp 518. The LED DC/DC module 512 may have an input voltage between 7 and 18 volts with a nominal voltage of approximately 13.2 volts and an output voltage that may be slightly higher (e.g., 0.3 volts) than a maximum voltage for the LED array (e.g., as determined by factor or local calibration and operating condition adjustments due to load, temperature or other factors).

The logic LDO module 514 may be coupled to the input filter and protection module 506 to receive the filtered power. The logic LDO module 514 may also be coupled to the micro-controller 516 and the active headlamp 518 to provide power to the micro-controller 516 and/or electronics in the active headlamp 518, such as CMOS logic.

The bus transceiver 508 may have, for example, a universal asynchronous receiver transmitter (UART) or serial peripheral interface (SPI) interface and may be coupled to the micro-controller 516. The micro-controller 516 may translate vehicle input based on, or including, data from the sensor module 510. The translated vehicle input may include a video signal that is transferrable to an image buffer in the active headlamp 518. In addition, the micro-controller 516 may load default image frames and test for open/short pixels during startup. In embodiments, an SPI interface may load an image buffer in CMOS. Image frames may be full frame, differential or partial frames. Other features of micro-controller 516 may include control interface monitoring of CMOS status, including die temperature, as well as logic LDO output. In embodiments, LED DC/DC output may be dynamically controlled to minimize headroom. In addition to providing image frame data, other headlamp functions, such as complementary use in conjunction with side marker or turn signal lights, and/or activation of daytime running lights, may also be controlled.

Figure 6:
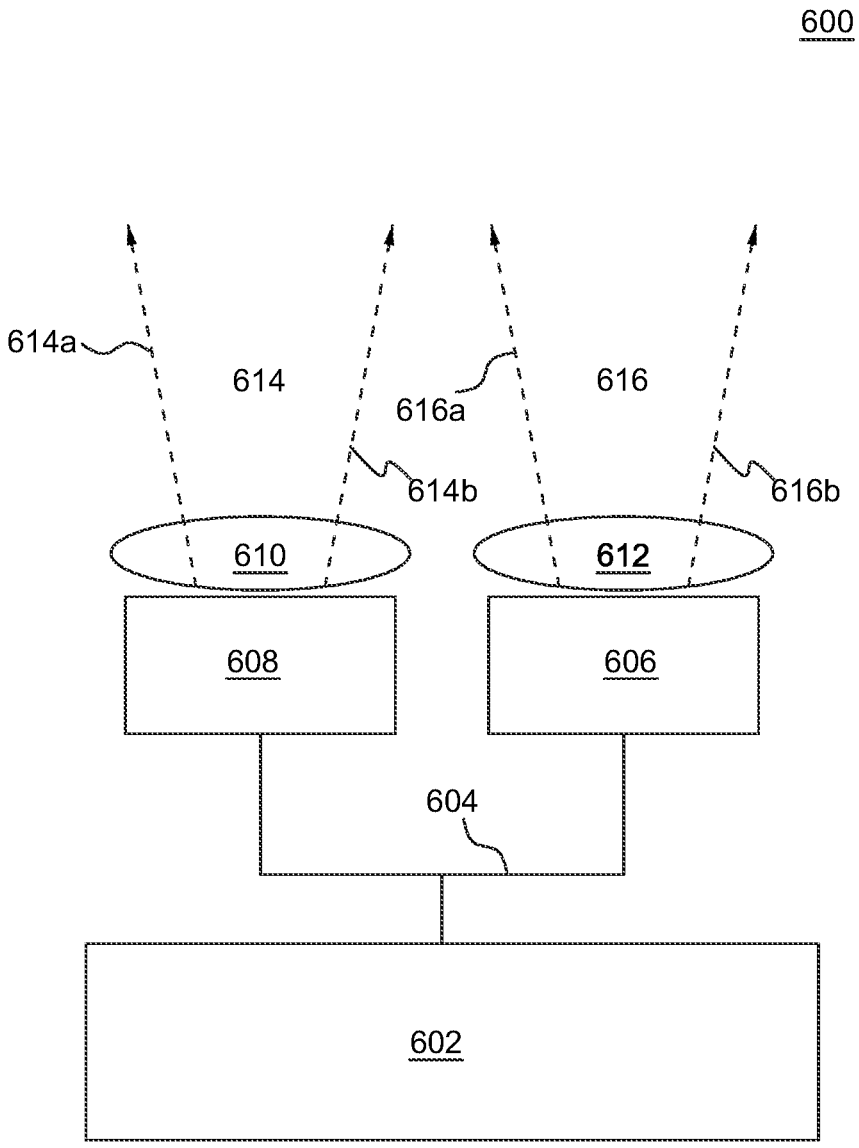
FIG. 6 is a diagram of another example vehicle headlamp system.

FIG. 6 is a diagram of another example vehicle headlamp system 600. The example vehicle headlamp system 600 illustrated in FIG. 6 includes an application platform 602, two LED lighting systems 606 and 608, and secondary optics 610 and 612.

The LED lighting system 608 may emit light beams 614 (shown between arrows 614*a* and 614*b* in FIG. 6). The LED lighting system 606 may emit light beams 616 (shown between arrows 616*a* and 616*b* in FIG. 6). In the embodiment shown in FIG. 6, a secondary optic 610 is adjacent the LED lighting system 608, and the light emitted from the LED lighting system 608 passes through the secondary optic 610. Similarly, a secondary optic 612 is adjacent the LED lighting system 606, and the light emitted from the LED lighting system 606 passes through the secondary optic 612. In alternative embodiments, no secondary optics 610/612 are provided in the vehicle headlamp system.

Where included, the secondary optics 610/612 may be or include one or more light guides. The one or more light guides may be edge lit or may have an interior opening that defines an interior edge of the light guide. LED lighting systems 608 and 606 may be inserted in the interior openings of the one or more light guides such that they inject light into the interior edge (interior opening light guide) or exterior edge (edge lit light guide) of the one or more light guides. In embodiments, the one or more light guides may shape the light emitted by the LED lighting systems 608 and 606 in a desired manner, such as, for example, with a gradient, a chamfered distribution, a narrow distribution, a wide distribution, or an angular distribution.

The application platform 602 may provide power and/or data to the LED lighting systems 606 and/or 608 via lines 604, which may include one or more or a portion of the power lines 502 and the data bus 504 of FIG. 5. One or more sensors (which may be the sensors in the vehicle headlamp system 600 or other additional sensors) may be internal or external to the housing of the application platform 602. Alternatively, or in addition, as shown in the example vehicle headlamp system 500 of FIG. 5, each LED lighting system 608 and 606 may include its own sensor module, connectivity and control module, power module, and/or LED array.

In embodiments, the vehicle headlamp system 600 may represent an automobile with steerable light beams where LEDs may be selectively activated to provide steerable light. For example, an array of LEDs or emitters may be used to define or project a shape or pattern or illuminate only selected sections of a roadway. In an example embodiment, infrared cameras or detector pixels within LED lighting systems 606 and 608 may be sensors (e.g., similar to sensors in the sensor module 510 of FIG. 5) that identify portions of a scene (e.g., roadway or pedestrian crossing) that require illumination.

Having described the embodiments in detail, those skilled in the art will appreciate that, given the present description, modifications may be made to the embodiments described herein without departing from the spirit of the inventive concept. Therefore, it is not intended that the scope of the invention be limited to the specific embodiments illustrated and described.

What is claimed is:

1. A lighting device comprising:

a mounting portion comprising at least a central mounting face and at least one lateral mounting face at an angle with respect to the central mounting face;

at least one first light emitting element on the central mounting face;

at least one second light emitting on the at least one lateral mounting face; and at least one optical component mounted to the mounting portion, the at least one optical component comprising a frame-shaped member mounted to an outer section of the central mounting face enclosing the at least one first light emitting element, the frame-shaped member comprising at least one wing portion that extends from the outer section of the central mounting face adjacent to the at least one lateral mounting face, such that the at least one optical component is configured to adjust an intensity distribution of light emitted from the at least one of the at least one first light emitting element or the at least one second light emitting element.

2. The lighting device according to claim 1, wherein the at least one wing portion extends along a length direction of the mounting portion, and wherein a width of the at least one wing portion in a direction perpendicular to the length direction away from the mounting portion is at least 20% of a corresponding width of a light emitting surface of the at least one second light emitting element.

3. The lighting device according to claim 1, wherein the at least one optical component comprises:

at least two wing portions respectively arranged at opposing sides with respect to the at least one first light emitting element, and at least one joining portion connecting the at least two wing portions.

4. The lighting device according to claim 3, wherein the at least one optical component comprises at least two joining portions, wherein the at least two wing portions and the at least two joining portions are at least in part arranged around the at least one first light emitting element.

5. The lighting device according to claim 3, wherein the at least two wing portions and the at least one joining portion are arranged in a common plane forming at least one essentially flat surface with a central opening, wherein the at least one first light emitting element protrudes at least in part through the central opening.

6. The lighting device according to claim 1, wherein the at least one wing portion comprises an at least partially reflective surface.

7. The lighting device according to claim 6, wherein the at least partially reflective surface forms an angle of at least 85° with the at least one lateral mounting face.

8. The lighting device according to claim 1, wherein the at least one optical component comprises at least one wing portion that extends from an outer section of the at least one lateral mounting face adjacent to the central mounting face.

9. The lighting device according to claim 1, wherein the at least one optical component comprises a tapered cross-section.

10. The lighting device according to claim 1, wherein the mounting portion further comprises a third mounting face adjacent to the central mounting face and opposing the at least one lateral mounting face.

11. The lighting device according to claim 10, further comprising at least one third light emitting arrangement on the third mounting face.

12. The lighting device according to claim 1, further comprising:

at least two first light emitting elements arranged along a length direction of the mounting portion; and at least two second light emitting elements arranged along the length direction.

13. The lighting device according to claim 12, wherein the at least one wing portion extends along a length direction of the mounting portion and spans at least an extension of the at least two first light emitting elements in the length direction.

14. An automotive lighting system comprising:

a reflector having a focus; and a lighting device mounted to the reflector at the focus, the lighting device comprising:

a mounting portion comprising at least a central mounting face and at least one lateral mounting face at an angle with respect to the central mounting face;

at least one first light emitting element on the central mounting face;

at least one second light emitting on the at least one lateral mounting face; and at least one optical component mounted to the mounting portion, the at least one optical component comprising a frame-shaped member mounted to an outer section of the central mounting face enclosing the at least one first light emitting element, the frame-shaped member comprising at least one wing portion that extends from the outer section of the central mounting face adjacent to the at least one lateral mounting face, such that the at least one optical component is configured to adjust an intensity distribution of light emitted from the at least one of the at least one first light emitting element or the at least one second light emitting element.

15. The system of claim 14, wherein the at least one wing portion extends along a length direction of the mounting portion, and wherein a width of the at least one wing portion in a direction perpendicular to the length direction away from the mounting portion is at least 20% of a corresponding width of a light emitting surface of the at least one second light emitting element.

16. A lighting device comprising:

a mounting portion comprising at least a central mounting face and at least one lateral mounting face at an angle with respect to the central mounting face;

at least one first light emitting element on the central mounting face;

at least one second light emitting on the at least one lateral mounting face; and at least one optical component mounted to the mounting portion and comprising:

at least two wing portions respectively arranged at opposing sides with respect to the at least one first light emitting element, and at least one joining portion connecting the at least two wing portions, the at least two wing portions and the at least one joining portion being arranged in a common plane forming at least one essentially flat surface with a central opening, wherein the at least one first light emitting element protrudes at least in part through the central opening, such that the at least one optical component is configured to adjust an intensity distribution of light emitted from the at least one of the at least one first light emitting element or the at least one second light emitting element.

* * * * *